US011227733B2

(12) United States Patent
Maeno et al.

(10) Patent No.: US 11,227,733 B2
(45) Date of Patent: Jan. 18, 2022

(54) SWITCH

(71) Applicant: Mitsubishi Electric Corporation, Tokyo (JP)

(72) Inventors: Satoru Maeno, Tokyo (JP); Daisuke Fujita, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 17/052,538

(22) PCT Filed: May 10, 2018

(86) PCT No.: PCT/JP2018/018191

§ 371 (c)(1),
(2) Date: Nov. 3, 2020

(87) PCT Pub. No.: WO2019/215885

PCT Pub. Date: Nov. 14, 2019

(65) Prior Publication Data

US 2021/0233725 A1 Jul. 29, 2021

(51) Int. Cl.

| | |
|---|---|
| ***H01H 33/40*** | (2006.01) |
| ***H01H 33/42*** | (2006.01) |
| ***H01H 15/00*** | (2006.01) |

(52) U.S. Cl.

CPC ..... *H01H 15/005* (2013.01); *H01H 33/40* (2013.01); *H01H 33/42* (2013.01)

(58) Field of Classification Search

CPC ..... H01H 33/40; H01H 33/42; H01H 33/56; H01H 33/565; H01H 33/64; H01H 3/3042; H01H 3/40; H01H 3/46

(Continued)

(56) References Cited

U.S. PATENT DOCUMENTS 5,901,838 A * 5/1999 Nakatani ..... H01H 3/30 200/400
6,444,934 B1 * 9/2002 Imura ..... H01H 3/3042 200/17 R (Continued)

FOREIGN PATENT DOCUMENTS

| | | | |
|---|---|---|---|
| JP | H04315720 | A | 11/1992 |
| JP | 6239193 | B1 | 11/2017 |
| WO | 2015107694 | A1 | 7/2015 |

OTHER PUBLICATIONS

International Search Report (with English Translation) and Written Opinion issued in corresponding International Patent Application No. PCT/JP2018/018191, 8 pages (dated Jul. 24, 2018).

*Primary Examiner* — William A Bolton
(74) *Attorney, Agent, or Firm* — Buchanan Ingersoll & Rooney PC

(57) ABSTRACT

A switch includes: a tank; a fixed contact and a reciprocally movable contact provided inside the tank; an opening/closing shaft that rotates to thereby move the movable contact; a jack base fixed to the outer side of the tank; a torsion bar that stores a force to rotate the opening/closing shaft so as to move the movable contact in a direction away from the fixed contact; and an opening/closing lever detachably attached to the opening/closing shaft. The jack base has a first penetrating portion formed therethrough and facing the opening/closing lever. The opening/closing lever has a second penetrating portion formed therethrough and facing the jack base. The switch further includes: a bolt inserted through the first penetrating portion and the second penetrating portion; and a nut attached to a portion of the bolt, the portion of the bolt extending out of the first penetrating portion and the second penetrating portion.

7 Claims, 13 Drawing Sheets

(58) Field of Classification Search
USPC ..... 200/537, 538, 542, 562, 564, 335, 434, 200/400; 218/55, 59, 67, 78, 79, 80
See application file for complete search history.

(56) References Cited

U.S. PATENT DOCUMENTS

| | | | | |
|---|---|---|---|---|
| 6,472,627 | B1 * | 10/2002 | Yoon | H01H 3/30 200/400 |
| 6,486,417 | B1 * | 11/2002 | Toyama | H01H 71/54 200/17 R |
| 6,610,949 | B2 * | 8/2003 | Mori | H01H 3/3015 200/400 |
| 6,903,636 | B2 * | 6/2005 | Fischer | H01H 3/60 200/553 |
| 7,528,336 | B2 * | 5/2009 | Hashimoto | H01H 33/40 200/400 |
| 2002/0056631 | A1 * | 5/2002 | Ohtsuka | H01H 3/3042 200/400 |
| 2019/0157016 | A1 | 5/2019 | Tanigaki et al. | |

* cited by examiner

SWITCH

FIELD

The present invention relates to a switch having an openable and closable contact inside a tank.

BACKGROUND

A known switch, which is installed in a substation or a switching station and has a contact movable between an open position and a closed position, includes a torsion bar as disclosed in Patent Literature 1. For such a switch, energy accumulated due to torsion applied to the torsion bar is used to open and close the contact.

CITATION LIST

Patent Literature

Patent Literature 1: Japanese Patent No. 6239193

SUMMARY

Technical Problem

In some case, the contact of the switch should be opened and closed in a maintenance operation such as replacement of a fixed contact and a movable contact that define the contact. Generally, a torsion bar applies a biasing force to a movable contact. For this reason, it is not easy to move the movable contact against the biasing force. To address such a problem, it has been necessary to provide the switch with a large-scale operation mechanism.

The present invention has been made in view of the above, and an object of the present invention is to obtain a switch that allows a movable contact to be easily moved against a biasing force from a torsion bar.

Solution to Problem

To solve the above problem and achieve the object, a switch according to the present invention comprises: a tank; a fixed contact provided inside the tank; a movable contact provided inside the tank and capable of reciprocating between a position where the movable contact is in contact with the fixed contact and a position away from the fixed contact; an opening/closing shaft rotatably provided outside the tank, rotation of the opening/closing shaft moving the movable contact; a jack base fixed to an outer side of the tank; a torsion bar to store a force to rotate the opening/closing shaft so as to move the movable contact in a direction away from the fixed contact; and an opening/closing lever detachably attached to the opening/closing shaft, wherein the jack base has a first penetrating portion formed therethrough and facing the opening/closing lever, the opening/closing lever has a second penetrating portion formed therethrough and facing the jack base, and the switch further comprises: a bolt inserted through the first penetrating portion and the second penetrating portion; and a nut attached to a portion of the bolt, the portion of the bolt extending out of the first penetrating portion and the second penetrating portion.

Advantageous Effects of Invention

A switch according to the present invention has the effect that the movable contact can be easily moved against the biasing force from the torsion bar.

DESCRIPTION OF EMBODIMENT

Hereinafter, a switch according to an embodiment of the present invention will be described in detail with reference to the drawings. Note that the present invention is not limited to the embodiment.

First Embodiment

Figure 1:
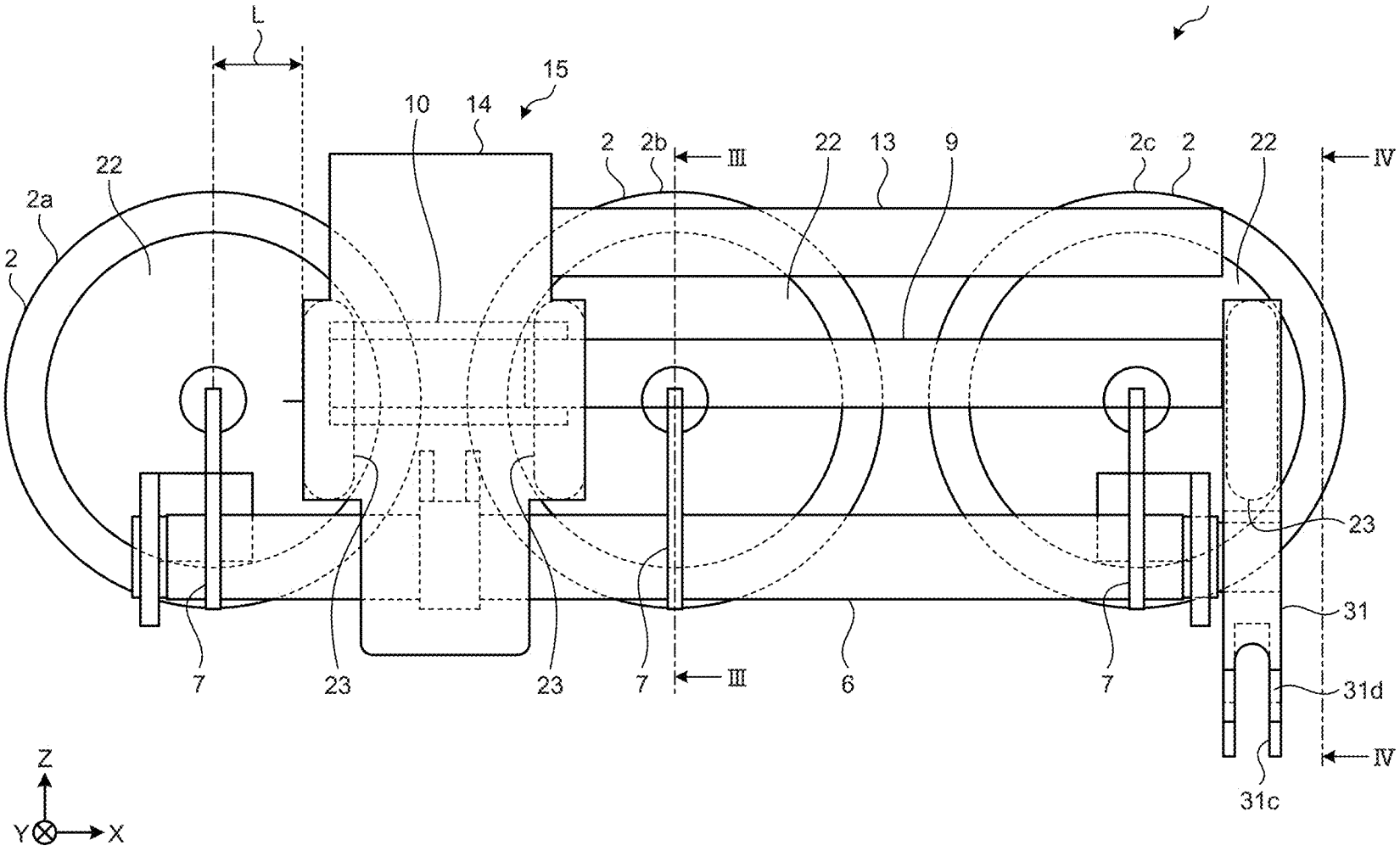
FIG. 1 is a front view of a switch according to a first embodiment of the present invention.
Figure 2:
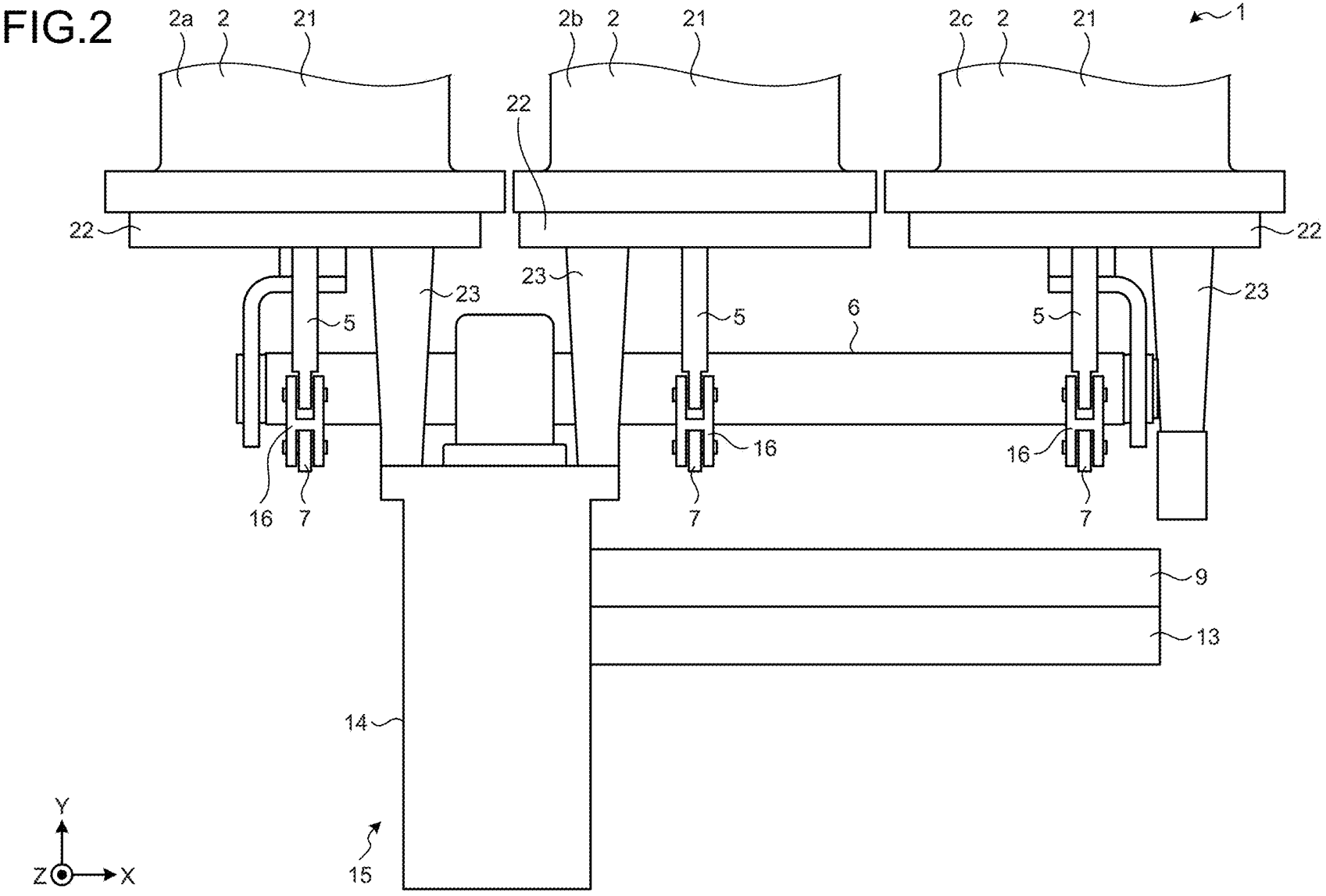
FIG. 2 is a plan view of the switch according to the first embodiment.
Figure 3:
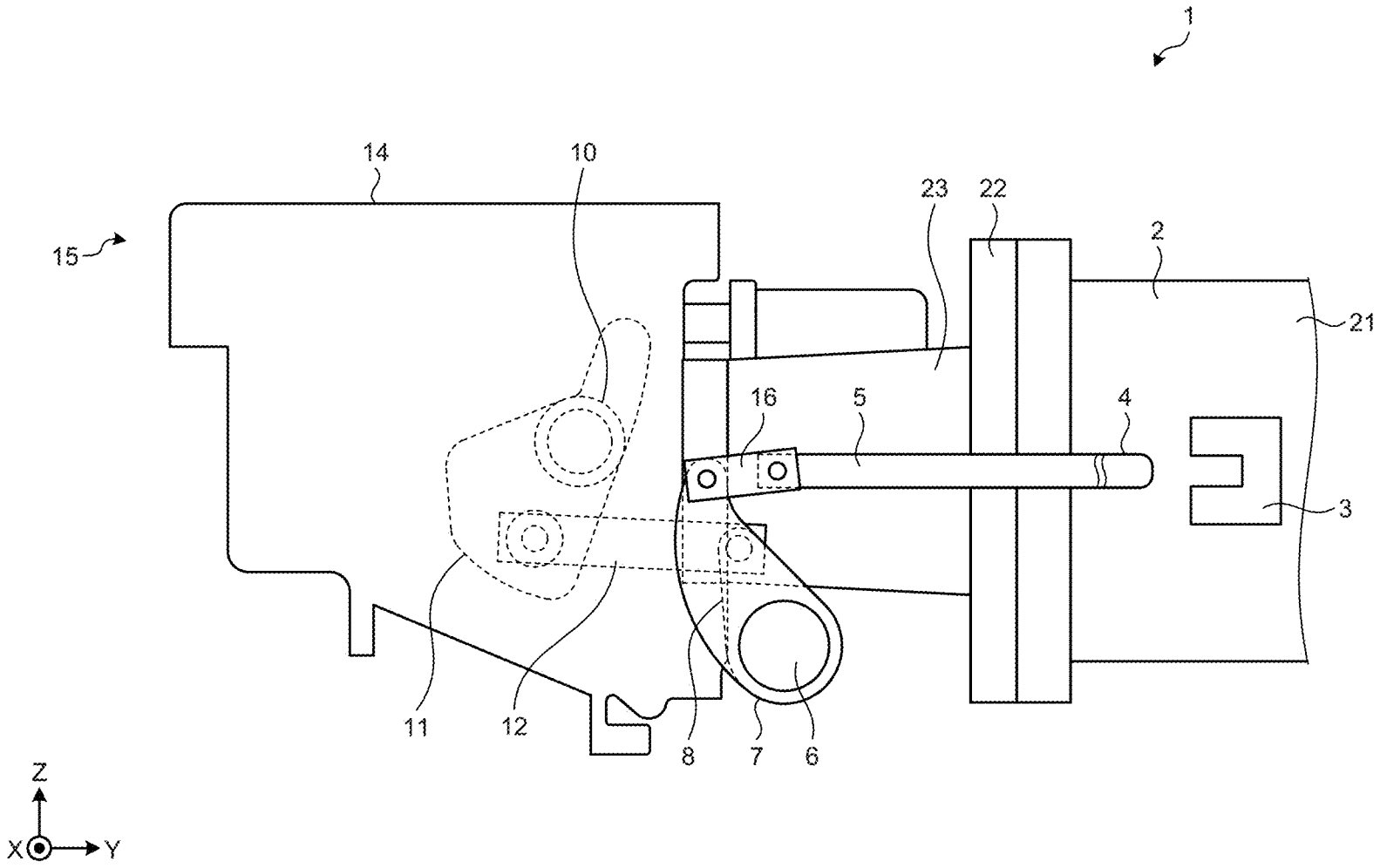
FIG. 3 is a sectional view taken along line III-III illustrated in FIG. 1.
Figure 4:
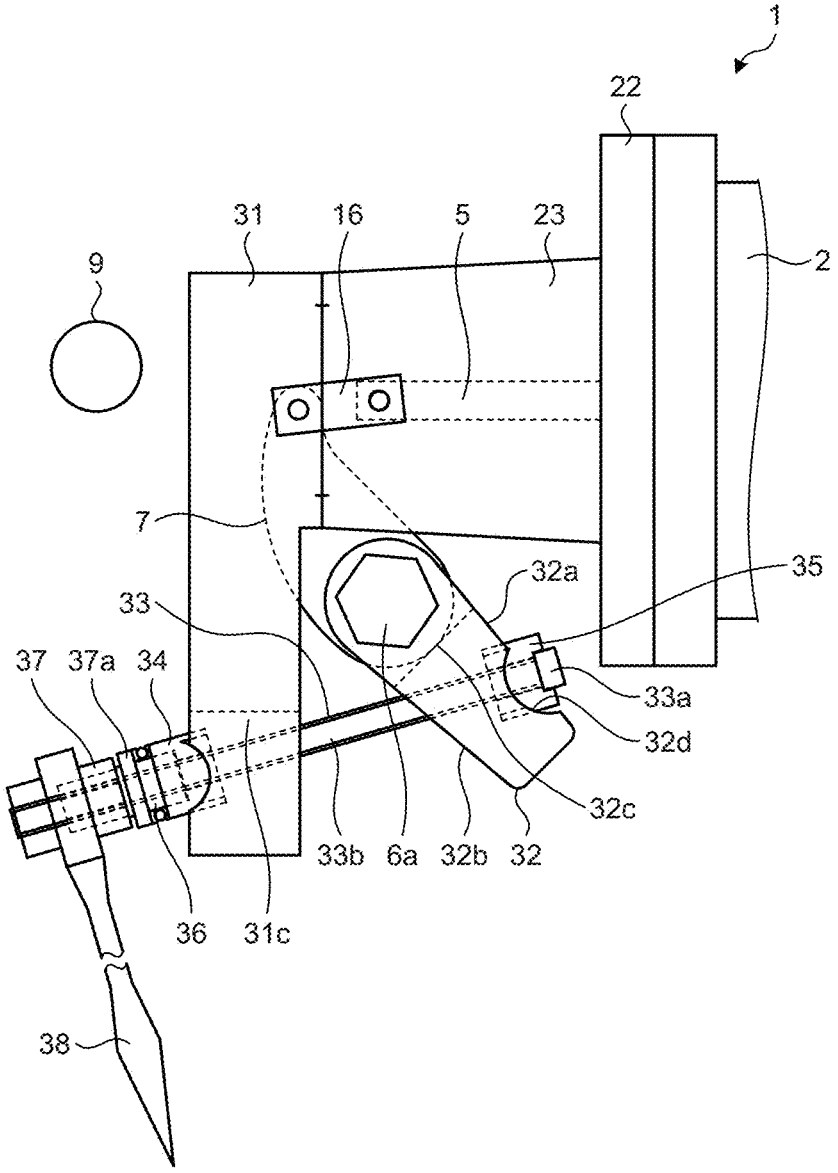
FIG. 4 is a sectional view taken along line IV-IV illustrated in FIG. 1.

FIG. 1 is a front view of a switch according to a first embodiment of the present invention. FIG. 2 is a plan view of the switch according to the first embodiment. FIG. 3 is a sectional view taken along line III-III illustrated in FIG. 1. FIG. 4 is a sectional view taken along line IV-IV illustrated in FIG. 1. A switch 1 includes three tanks, a first tank 2*a*, a second tank 2*b*, and a third tank 2*c*. Note that the three tanks 2*a* to 2*c* may be simply referred to as tanks 2 without distinction. The three tanks 2*a* to 2*c* are arranged in a straight line. The direction of the arrangement of the three tanks 2*a* to 2*c* are arranged is defined as an X-axis direction.

The tank 2 includes a tubular main body 21 and a lid 22 that covers an end of the main body 21. The inside of the tank 2 is a closed space. The tank 2 may be filled with an insulating gas, or may be filled with the same air as the outside air. Furthermore, the tank 2 may be evacuated.

A mounting seat 23 is provided on the lid 22. A housing of an operation device or a jack base is fixed to the mounting seat 23, as will be described later. The lid 22 and the mounting seat 23 are formed integrally with each other. A fixed contact 3 and a movable contact 4 are provided inside the tank 2. The fixed contact 3 is fixed to the inside of the tank 2 via an insulator (not illustrated).

The movable contact 4 is capable of reciprocating between a position where the movable contact 4 is in contact with the fixed contact 3 and a position away from the fixed contact 3. The movable contact 4 and the fixed contact 3, which form a circuit contact, can move into contact with and away from each other. The switch 1 is a three-phase separation type switch in which the circuit contact defined by the movable contact 4 and the fixed contact 3 are provided in each of the tanks 2*a* to 2*c*. The movable contact 4 moves in a direction perpendicular to the X-axis. The direction of the movement of the movable contact 4 is defined as a Y-axis direction. Furthermore, a direction perpendicular to the X-axis and the Y-axis is defined as a Z-axis direction.

The movable contact 4 is connected to a contact rod 5 extending through the lid 22 to the outside of the tank 2. The contact rod 5 passes through the lid 22 via the center of the tank 2. An opening/closing shaft 6 is provided outside the tank 2 in such a way as to rotate about a rotation axis parallel to the X-axis. The opening/closing shaft 6 is a rod-shaped member extending in a direction parallel to the X-axis.

Figure 5:
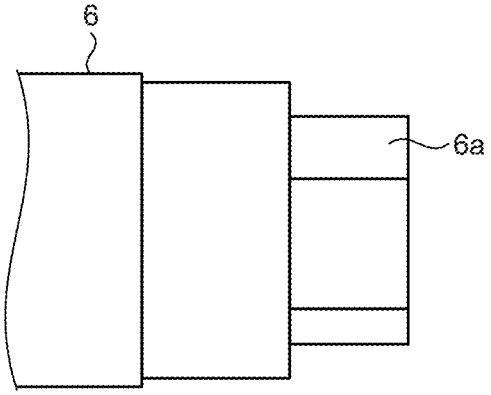
FIG. 5 is an enlarged view of an end of an opening/closing shaft in the first embodiment.

FIG. 5 is an enlarged view of an end of the opening/closing shaft in the first embodiment. As illustrated in FIGS. 4 and 5, a protrusion 6*a* is formed at the end of the opening/closing shaft 6. The protrusion 6*a* is hexagonal in cross section. A shaft first lever 7 and a shaft second lever 8 are provided on the opening/closing shaft 6. The shaft first lever 7 and the shaft second lever 8 rotate together with the opening/closing shaft 6.

The shaft first lever 7 and the contact rod 5 are connected to each other by a link mechanism 16. Since the shaft first lever 7 and the contact rod 5 are connected to each other by the link mechanism 16, the movable contact 4 moves in a direction in which the movable contact 4 comes into contact with the fixed contact 3 or in a direction away from the fixed contact 3, in accordance with the direction of rotation of the opening/closing shaft 6. Specifically, when the opening/closing shaft 6 rotates clockwise under the condition illustrated in FIGS. 3 and 4, the movable contact 4 moves in the direction in which the movable contact 4 comes into contact with the fixed contact 3. Furthermore, when the opening/closing shaft 6 rotates counterclockwise, the movable contact 4 moves in the direction away from the fixed contact 3.

The shaft first lever 7 and the shaft second lever 8 are provided in correspondence to each of the movable contacts 4 provided in the tanks 2*a* to 2*c*. Therefore, the movable contacts 4 provided in the tanks 2*a* to 2*c* can be operated together by rotation of the opening/closing shaft 6. That is, rotating the opening/closing shaft 6 can open and close the circuit contacts provided in the tanks 2*a* to 2*c*.

The switch 1 includes a breaking torsion bar 9 which is a breaking spring. The breaking torsion bar 9 is a bar-shaped spring extending parallel to the X-axis. The breaking torsion bar 9 is twisted about a rotation axis parallel to the X-axis, thereby storing a force to return from the twisted position.

A breaking shaft 10 is connected to the breaking torsion bar 9. Rotating the breaking shaft 10 in FIG. 3 counterclockwise around a rotation axis parallel to the X-axis twists the breaking torsion bar 9, such that the breaking torsion bar 9 stores the force therein.

A breaking lever 11 is connected to the breaking shaft 10. The breaking lever 11 rotates together with the breaking shaft 10. The breaking shaft 10 and the breaking lever 11 are connected to each other by a breaking rod 12. Since the breaking shaft 10 and the breaking lever 11 are connected to each other by the breaking rod 12, the shaft second lever 8 can be rotated in accordance with the direction of rotation of the breaking shaft 10.

That is, rotation of the breaking shaft 10 can move the movable contact 4 connected to the breaking shaft 10, via the shaft second lever 8, the opening/closing shaft 6, the shaft first lever 7, and the contact rod 5. As described above, a force to rotate the breaking shaft 10 clockwise is applied to the breaking shaft 10, and thus a force is applied to the movable contact 4 in the direction away from the fixed contact 3.

The switch 1 includes a closing torsion bar 13 which is a closing spring. As with the breaking torsion bar 9, the closing torsion bar 13 is twisted about a rotation axis parallel to the X-axis, thereby storing a force therein. The switch 1 includes a linkage mechanism that links the operation of the breaking torsion bar 9, the operation of the closing torsion bar 13, and the operation of the movable contact 4 with one another. Note that illustration of the linkage mechanism is omitted. Release of the force stored in the closing torsion bar 13 causes the movable contact 4 to move in such a direction as to come into contact with the fixed contact 3. The contact of the movable contact 4 with the fixed contact 3 closes the circuit contact. When the force stored in the closing torsion bar 13 is released, the linkage mechanism uses the released force to thereby twist the breaking torsion bar 9, so that a force is stored in the breaking torsion bar 9. Thereafter, the force stored in the breaking torsion bar 9 is released to thereby move the movable contact 4 in the direction away from the fixed contact 3. The movement of the movable contact 4 away from the fixed contact 3 opens the circuit contact.

In the present embodiment, the force stored in the breaking torsion bar 9 is not completely released with the circuit contact open. That is, with the circuit contact open as illustrated in FIG. 3, the breaking torsion bar 9, which is in a counterclockwise twisted state, is subjected to a force acting to rotate the breaking torsion bar 9 clockwise. As a result, a force acting to rotate the breaking shaft 10 clockwise is constantly applied to the breaking shaft 10. Note that although the force stored in the closing torsion bar 13 is released in closing the circuit contact, such a release is not complete. Storing the force in the closing torsion bar 13 is accomplished by an electric motor (not illustrated) twisting the closing torsion bar 13. The storage of the force in the closing torsion bar 13 is done after the circuit contact is opened. This does not mean that simply opening the circuit contact stores a force in the closing torsion bar 13.

The switch 1 includes a housing 14 that accommodates therein the breaking shaft 10, the breaking lever 11, the breaking rod 12, and the linkage mechanism (not illustrated). The breaking shaft 10, the breaking lever 11, the breaking rod 12, the linkage mechanism (not illustrated), and the housing 14 define an operation device 15 that moves the movable contact 4. The housing 14 is fixed through bolts (not illustrated) to the mounting seat 23 provided on the lid 22 of the first tank 2*a* and the mounting seat 23 provided on the lid 22 of the second tank 2*b*.

In some case, maintenance such as replacement of the movable contact 4 and the fixed contact 3 is performed in the switch 1. In some case, the movable contact 4 should be moved when maintenance is performed. Such a case is, for example, where it is necessary to check an operation of the movable contact by moving the movable contact 4 to open and close the circuit contact. Since the force is stored in the breaking torsion bar 9 even after the circuit contact is opened as described above, it may be difficult to manually move the movable contact 4 against such a force. To address this problem, the present embodiment provides the switch 1 with an operation unit that allows the movable contact 4 to be manually moved with ease.

Next, the operation unit will be described. The operation unit includes a jack base 31, an opening/closing lever 32, an opening/closing bolt 33, a jack adapter 34, a lever adapter 35, a thrust bearing 36, and an opening/closing nut 37.

The jack base 31 is fixed through a bolt (not illustrated) to the mounting seat 23 provided on the lid 22 of the third tank 2*c*. As illustrated in FIG. 1, the jack base 31 protrudes from the mounting seat 23 toward the opening/closing shaft 6 when viewed from a direction along arrow Y.

Figure 6:
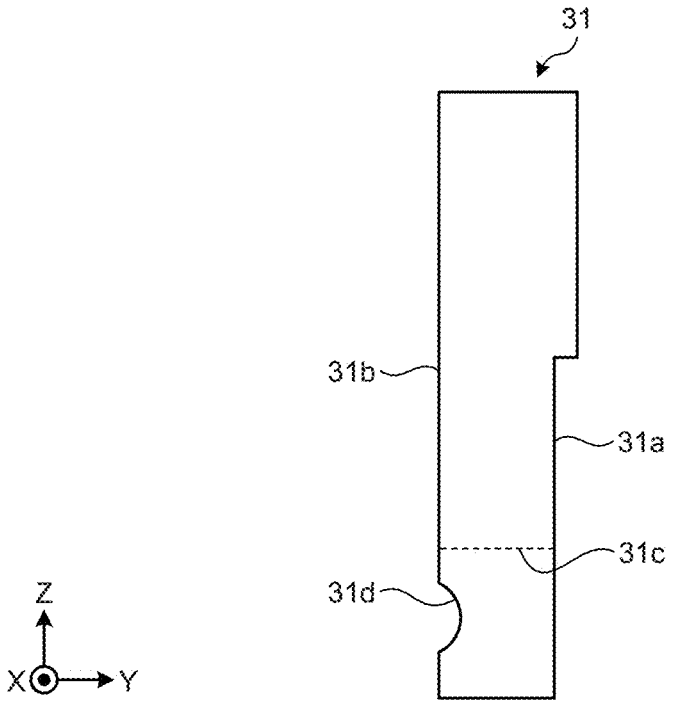
FIG. 6 is a side view of a jack base in the first embodiment.
Figure 7:
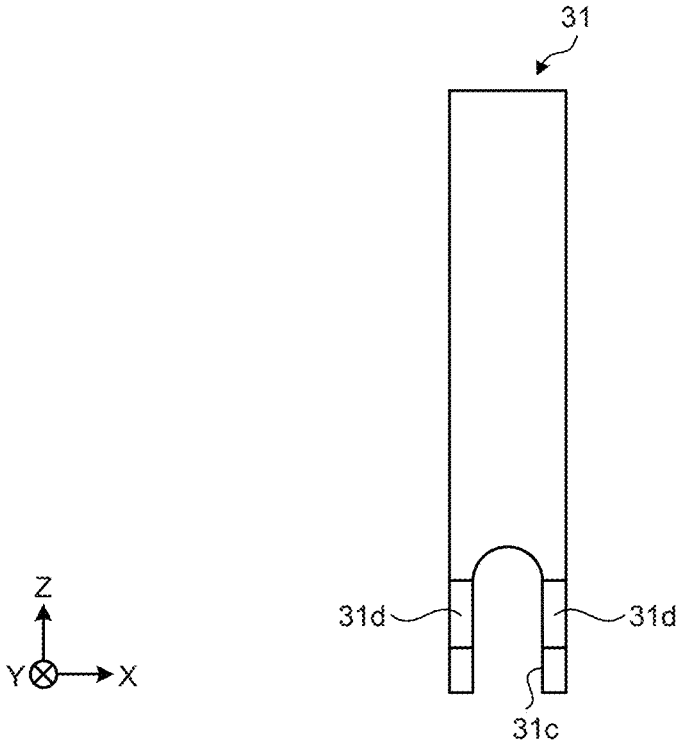
FIG. 7 is a front view of the jack base in the first embodiment.

FIG. 6 is a side view of the jack base in the first embodiment. FIG. 7 is a front view of the jack base in the first embodiment. The jack base 31 has first surface 31*a* fixed to the mounting seat 23, and a second surface 31*b* opposite to the first surface 31*a*. A penetrating portion 31*c* is formed through the jack base 31 from the first surface 31*a* to the second surface 31*b*. The penetrating portion 31*c* is a first penetrating portion. The penetrating portion 31*c* in the first embodiment is a groove. Jack-side recesses 31*d* are formed on a part of the second surface 31*b* of the jack base 31, the part surrounding the penetrating portion 31*c*. The jack-side recesses 31*d* each have an arc shape when viewed along the X-axis. In other words, the jack-side recesses 31*d* are formed in a region facing the opening/closing nut 37. The central axis of arc surfaces of the jack-side recesses 31*d* is parallel to the rotation axis of the opening/closing shaft 6.

Figure 8:
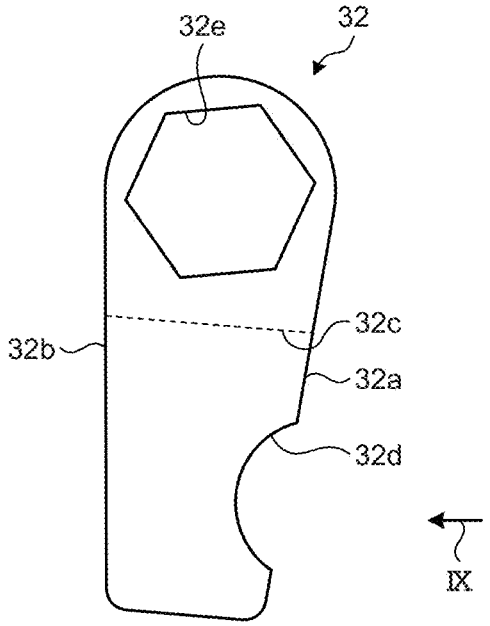
FIG. 8 is a front view of an opening/closing lever in the first embodiment.
Figure 9:
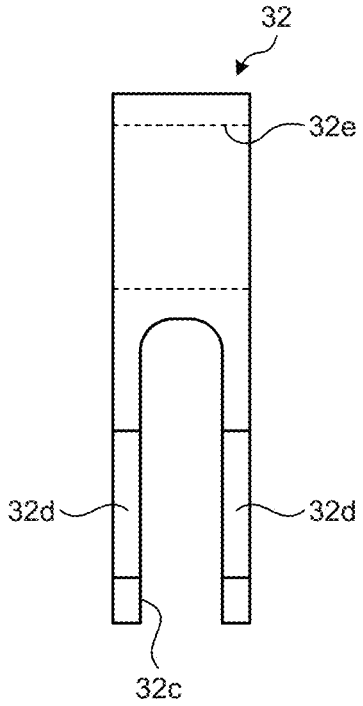
FIG. 9 is a diagram illustrating the opening/closing lever viewed along arrow IX illustrated in FIG. 8.

FIG. 8 is a front view of the opening/closing lever in the first embodiment. FIG. 9 is a diagram illustrating the opening/closing lever viewed along arrow IX illustrated in FIG. 8. The opening/closing lever 32 has a first surface 32*a* facing the third tank 2*c* and a second surface 32*b* opposite the first surface 32*a*. A penetrating portion 32*c* is formed through the opening/closing lever 32 from the first surface 32*a* to the second surface 32*b* on the opposite side. The penetrating portion 32*c* is a second penetrating portion. The penetrating portion 32*c* is a groove in the present embodiment, that is, the first embodiment. Lever-side recesses 32*d* are formed on a part of the first surface 32*a* of the opening/closing lever 32, the part surrounding the penetrating portion 32*c*. The lever-side recesses 32*d* each have an arc shape when viewed along the X-axis. In other words, the lever-side recesses 32*d* are formed in a region facing a head 33*a* of the opening/closing bolt 33. The central axis of arc surfaces of the lever-side recesses 32*d* is parallel to the rotation axis of the opening/closing shaft 6. A through hole 32*e* is formed through the opening/closing lever 32. The through hole 32*e* has a hexagonal shape, and extends through the opening/closing lever 32 in the direction along the X-axis.

It is possible to attach the opening/closing lever 32 to the end of the opening/closing shaft 6 by inserting the protrusion 6*a* formed at the end of the opening/closing shaft 6 into the through hole 32*e* of the opening/closing lever 32. It is possible to rotate the opening/closing shaft 6 by rotating the opening/closing lever 32 with the protrusion 6*a* fitting in the through hole 32*e*.

The penetrating portion 31*c* formed through the jack base 31 faces the opening/closing lever 32 attached to the end of the opening/closing shaft 6. Furthermore, the penetrating portion 32*c* formed through the opening/closing lever 32 faces the jack base 31 with the opening/closing lever 32 attached to the end of the opening/closing shaft 6.

Figure 10:
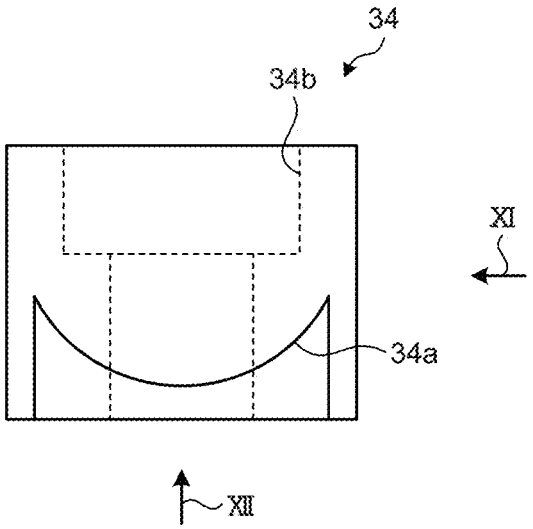
FIG. 10 is a front view of a jack adapter in the first embodiment.
Figure 11:
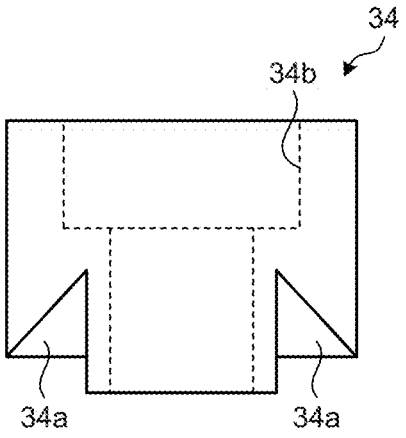
FIG. 11 is a diagram illustrating the jack adapter viewed along arrow XI illustrated in FIG. 10.
Figure 12:
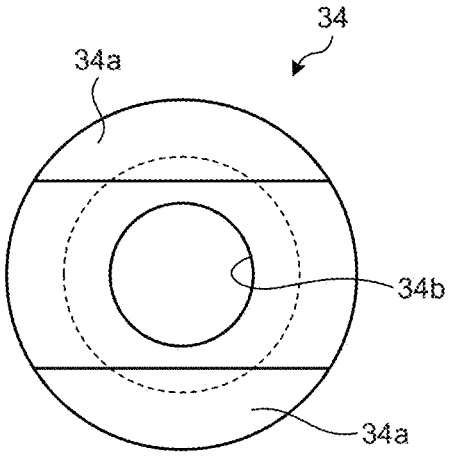
FIG. 12 is a diagram illustrating the jack adapter viewed along arrow XII illustrated in FIG. 10.

As illustrated in FIG. 4, the jack adapter 34 is attached to the jack-side recesses 31*d* of the jack base 31. FIG. 10 is a front view of the jack adapter in the first embodiment. FIG. 11 is a diagram illustrating the jack adapter viewed along arrow XI illustrated in FIG. 10. FIG. 12 is a diagram illustrating the jack adapter viewed along arrow XII illustrated in FIG. 10.

The jack adapter 34 has a cylindrical shape. An abutment surface 34*a* is formed on the outer peripheral surface of the jack adapter 34 such that the abutment surface 34*a* abuts on the jack-side recesses 31*d* of the jack base 31 along the shapes of the jack-side recesses 31*d*. The abutment surface 34*a* is an arc surface as with the jack-side recesses 31*d*. The abutment between the abutment surface 34*a* and the jack-side recesses 31*d*, which is an abutment between the arc surfaces, allows the jack adapter 34 to change its posture such that the jack adapter 34 rotates about the central axis of the arc surface.

A step is formed on the inner peripheral surface of the jack adapter 34. Thus, a through hole 34*b* formed through the jack adapter 34 has a diameter smaller on a side of the jack base 31 than on a side opposite to the jack base 31.

Figure 13:
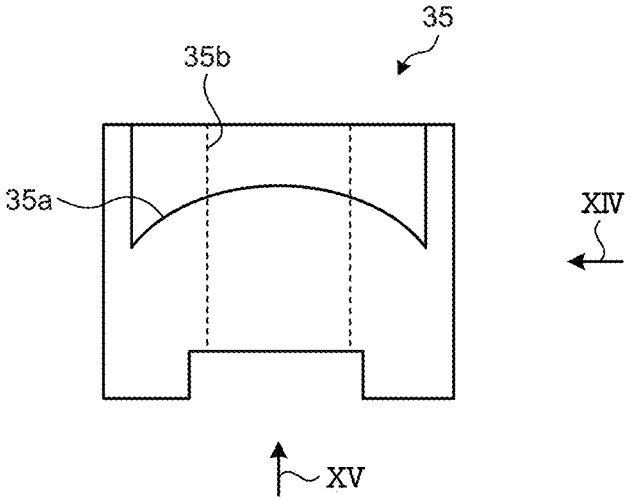
FIG. 13 is a front view of a lever adapter.
Figure 14:
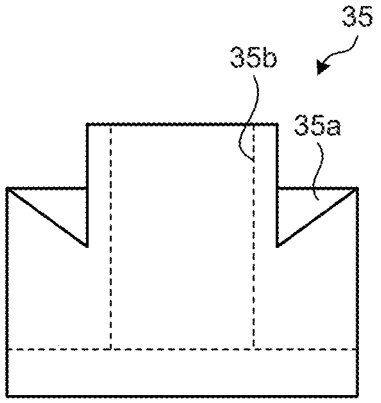
FIG. 14 is a diagram illustrating the lever adapter viewed along arrow XIV illustrated in FIG. 13.
Figure 15:
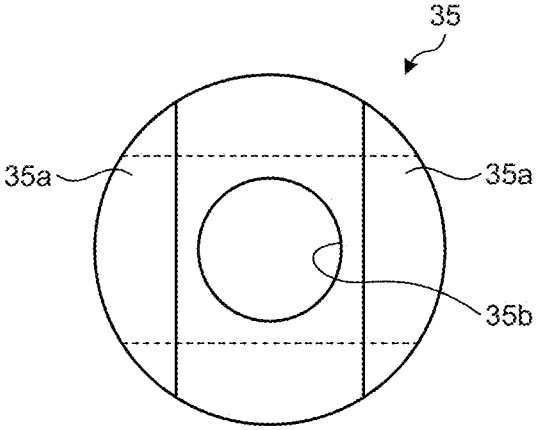
FIG. 15 is a diagram illustrating the lever adapter viewed along arrow XV illustrated in FIG. 13.

As illustrated in FIG. 4, the lever adapter 35 is attached to the lever-side recesses 32*d* of the opening/closing lever 32. FIG. 13 is a front view of the lever adapter. FIG. 14 is a diagram illustrating the lever adapter viewed along arrow XIV illustrated in FIG. 13. FIG. 15 is a diagram illustrating the lever adapter viewed along arrow XV illustrated in FIG. 13.

The lever adapter 35 has a cylindrical shape. A abutment surface 35*a* is formed on the outer peripheral surface of the lever adapter 35 such that the abutment surface 35*a* abuts on the lever-side recesses 32*d* of the opening/closing lever 32 along the shapes of the lever-side recesses 32*d*. The abutment surface 35*a* is an arc surface as with the lever-side recesses 32*d*. The abutment between the abutment surface 35*a* and the lever-side recesses 32*d*, which is an abutment between the arc surfaces, allows the lever adapter 35 to change its posture such that the lever adapter 35 rotates about the central axis of the arc surface. A through hole 35*b* is formed through the lever adapter 35.

The thrust bearing 36 has an annular shape. As illustrated in FIG. 4, the thrust bearing 36 is sandwiched between the opening/closing nut 37 and the jack adapter 34. The thrust bearing 36 serves to smoothly rotate the opening/closing nut 37 even when a compressive force is applied to the thrust bearing 36 from the opening/closing nut 37 and the jack adapter 34.

The opening/closing bolt 33 has the head 33*a* and a shaft 33*b*. With the head 33*a* of the opening/closing bolt 33 located on a side of the opening/closing lever 32, the shaft 33*b* of the opening/closing bolt 33 is inserted through the penetrating portion 32*c* of the opening/closing lever 32 and the penetrating portion 31*c* of the jack base 31. As illustrated in FIG. 4, the shaft 33*b* is also inserted through the through hole 35*b* of the lever adapter 35 and the through hole 34*b* of the jack adapter 34.

Figure 16:
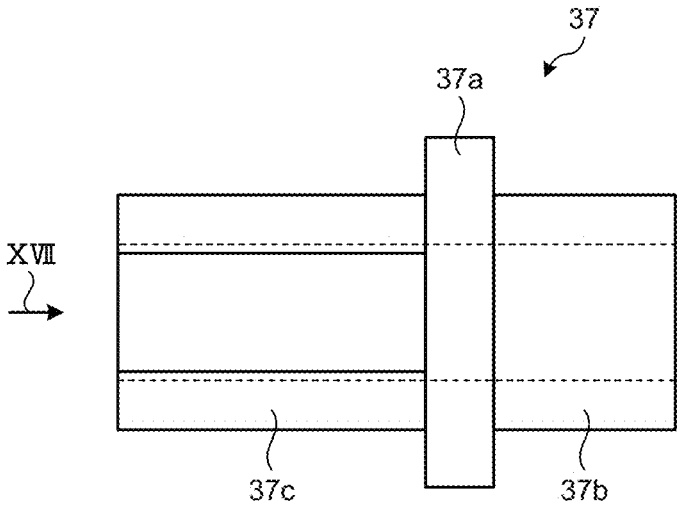
FIG. 16 is a side view of an opening/closing nut in the first embodiment.
Figure 17:
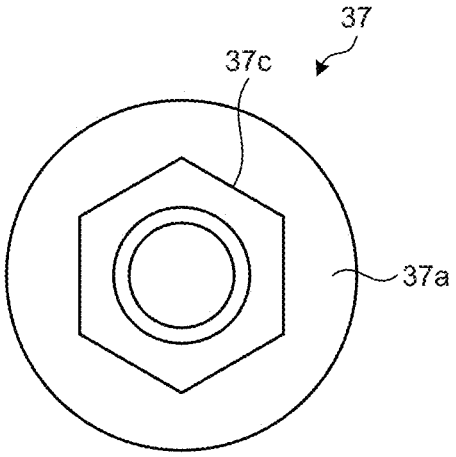
FIG. 17 is a diagram illustrating the opening/closing nut viewed along arrow XVII illustrated in FIG. 16.

The opening/closing nut 37 is attached to the shaft 33*b* of the opening/closing bolt 33. FIG. 16 is a side view of the opening/closing nut in the first embodiment. FIG. 17 is a diagram illustrating the opening/closing nut viewed along arrow XVII illustrated in FIG. 16. The opening/closing nut 37 has a flange 37*a*. The opening/closing nut 37 has one portion 37*b* defining one side of the flange 37*a*, and an opposite portion 37*c* defining the opposite side of the flange 37*a*. The one portion is inserted into the through hole 34*b* of the jack adapter 34. The opposite portion 37*c* has a shape that allows a tool such as a ratchet 38 to fit in the opposite portion 37*c*. For example, the other portion 37*c* has a hexagonal shape as illustrated in FIG. 17.

Tightening the opening/closing nut 37 on the shaft 33*b* of the opening/closing bolt 33 by using a tool such as the ratchet 38 rotates the opening/closing lever 32 such that the lever-side recesses 32*d* of the opening/closing lever 32 approach the jack base 31. At this time, a compressive force is applied to the flange 37*a* of the opening/closing nut 37 and the jack adapter 34, but the opening/closing nut 37 can be smoothly rotated as the thrust bearing 36 is sandwiched therebetween.

Figure 18:
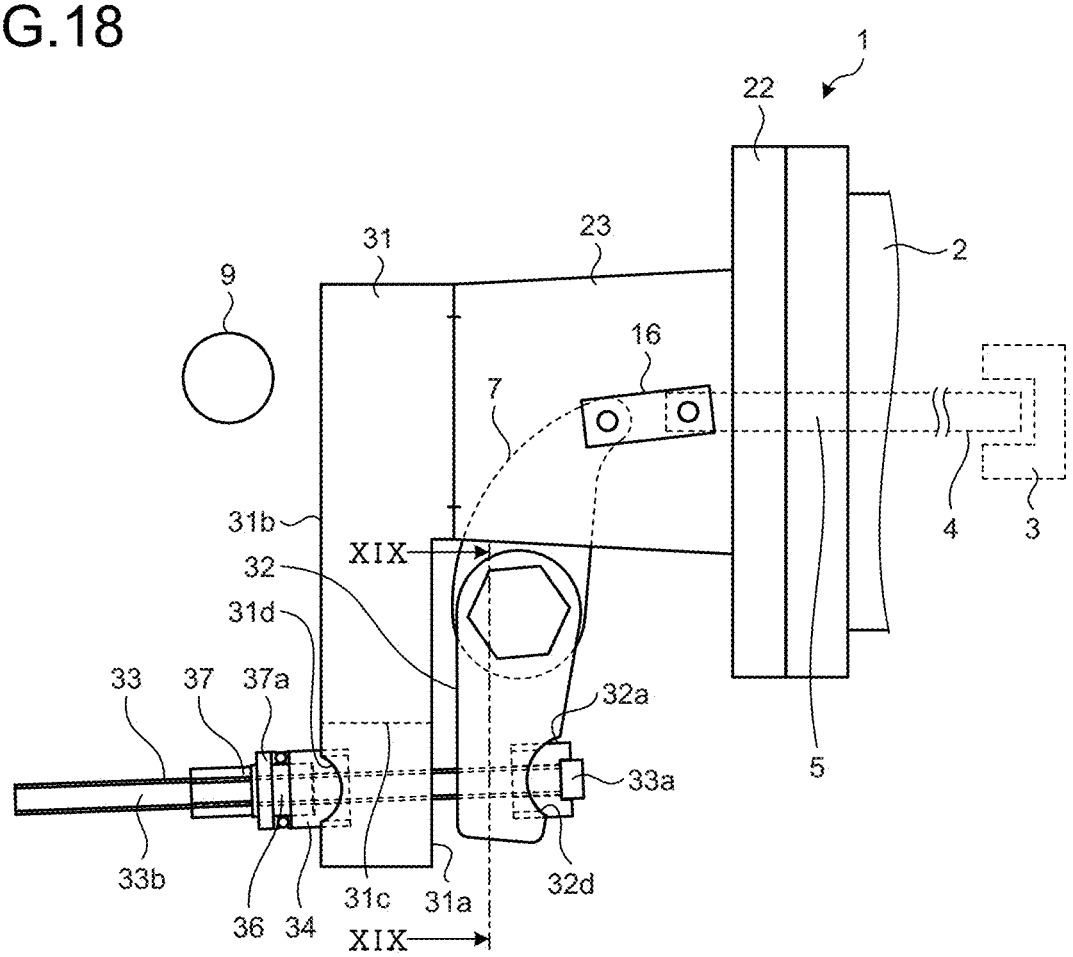
FIG. 18 is a diagram illustrating a state in which the opening/closing nut has been further tightened as compared with the state illustrated in FIG. 4.
Figure 19:
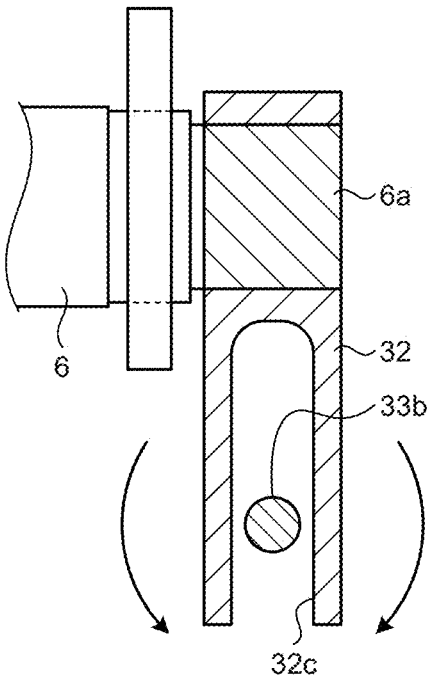
FIG. 19 is a sectional view taken along line XIX-XIX illustrated in FIG. 18.

FIG. 18 is a diagram illustrating a state in which the opening/closing nut has been further tightened as compared with the state illustrated in FIG. 4. FIG. 19 is a sectional view taken along line XIX-XIX illustrated in FIG. 18. As illustrated in FIG. 18, tightening the opening/closing nut 37 reduces the distance between the head 33*a* of the opening/closing bolt 33 and the opening/closing nut 37, such that the opening/closing shaft 6 and the shaft first lever 7 can be rotated to bring the movable contact 4 into contact with the fixed contact 3.

Use of a tool such as the ratchet 38 to tighten the opening/closing nut 37 provides a larger force to bring the movable contact 4 into contact with the fixed contact 3 than in moving the movable contact 4 without using a tool or the like. Thus, it is possible to easily move the movable contact 4 against the force applied to the movable contact 4 from the breaking torsion bar 9. Furthermore, a simple structure, which attaches the jack base 31 and the opening/closing lever 32 to the mounting seat 23 and the opening/closing shaft 6, can achieve space saving and cost reduction without requiring a large-scale operation mechanism.

Meanwhile, when the opening/closing nut 37 is loosened, the distance between the head 33*a* of the opening/closing bolt 33 and the opening/closing nut 37 increases, where, due to a force stored in the breaking torsion bar 9, a force to rotate the opening/closing shaft 6 counterclockwise in FIG. 18 is applied to the opening/closing shaft 6. As a result, the opening/closing shaft 6 and the opening/closing lever 32 rotate counterclockwise in accordance with an increase in the distance between the head 33*a* of the opening/closing bolt 33 and the opening/closing nut 37, such that the movable contact 4 moves away from the fixed contact 3.

When the maintenance is completed, the opening/closing lever 32 and the jack base 31 can be removed to restore the switch 1 to the normal operating state. If the opening/closing lever 32 remains attached to the opening/closing shaft 6, the moment of inertia of the opening/closing shaft 6 increases, and the rotation speed of the opening/closing shaft 6 decreases during normal operation. This may reduce the moving speed of the movable contact 4. The switch 1 requires the high-speed closing and high-speed breaking of the circuit contacts. In the first embodiment, the opening/closing lever 32 can be removed from the opening/closing shaft 6 except during maintenance. It is therefore possible to prevent the moving speed of the movable contact 4 from decreasing due to an increase in the moment of inertia.

Furthermore, in the first embodiment, the mounting seat 23 provided on the lid 22 of the tank 2 is used for fixing the housing 14 of the operation unit and the jack base 31, as illustrated in FIG. 1. Specifically, the mounting seat 23 is formed at an offset position from a part of the lid 22 through which the contact rod 5 extends. That is, the mounting seat 23 is offset from the central part of the tank 2. The lid 22 of the first tank 2*a* is disposed in such a position that the mounting seat 23 is located closer to the second tank 2*b* than the part of the lid 22 through which the contact rod 5 extends. Furthermore, the lid 22 of the second tank 2*b* is disposed in such a position that the mounting seat 23 is located closer to the first tank 2*a* than the part of the lid 22 through which the contact rod 5 extends. The operation device 15 is fixed to the mounting seat 23 of the first tank 2*a* and the mounting seat 23 of the second tank 2*b*. Moreover, the mounting seat 23 of the third tank 2*c* is disposed farther from the second tank 2*b* than the part of the lid 22 through which the contact rod 5 extends. The jack base 31 is fixed to the mounting seat 23 of the third tank 2*c*. Providing the common lids 22 at the different positions in the above manner allows fixing the operation device 15 and the jack base 31. That is, as the common lids 22 are used, the manufacturing cost of the switch 1 can be reduced. Note that it is desirable that a distance L between the center of the tank 2 and the position of the mounting seat 23 be 50 mm to 500 mm.

Furthermore, as illustrated in FIGS. 4 and 18, an angle between the shaft 33*b* of the opening/closing bolt 33 and each of the jack base 31 and the opening/closing lever 32 varies depending on how much the opening/closing nut 37 is tightened. In the first embodiment, the jack adapter 34 and the lever adapter 35, which rotate in accordance with an amount of tightening of the opening/closing nut 37, accommodate changes in the angle.

Figure 20:
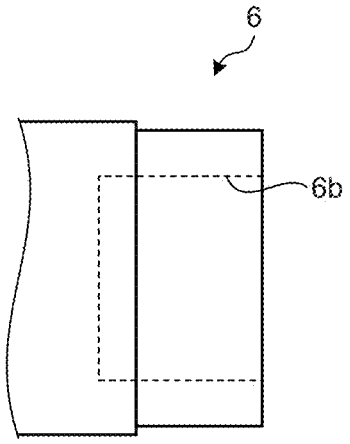
FIG. 20 is a diagram illustrating a modified example of the opening/closing shaft in the first embodiment.
Figure 21:
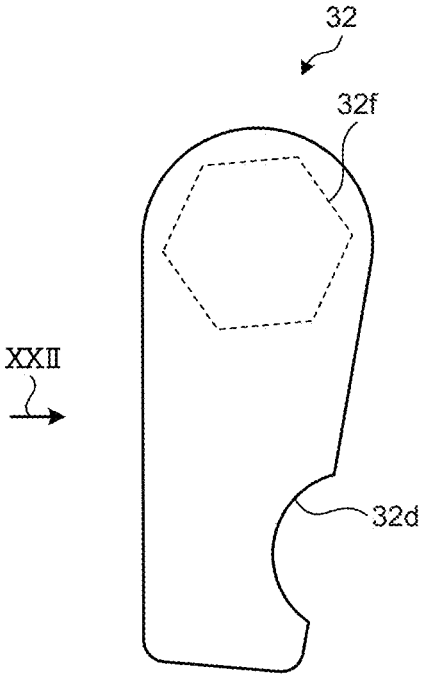
FIG. 21 is a diagram illustrating a modified example of the opening/closing lever in the first embodiment.
Figure 22:
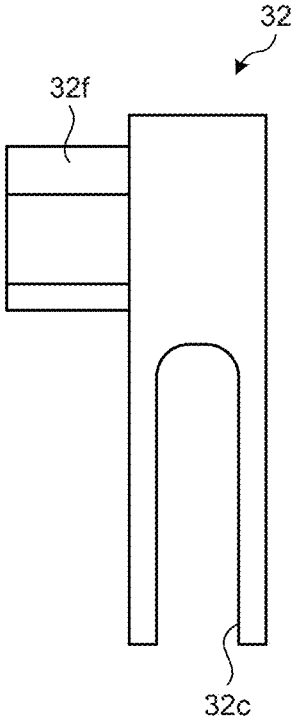
FIG. 22 is a diagram illustrating the opening/closing lever viewed along arrow XXII illustrated in FIG. 21.
Figure 23:
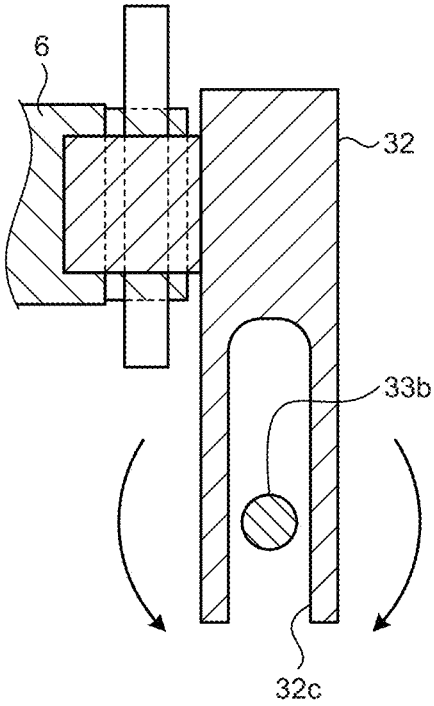
FIG. 23 is a diagram illustrating the opening/closing shaft and the opening/closing lever according to the modified examples in a state corresponding to the state illustrated in FIG. 19.

FIG. 20 is a diagram illustrating a modified example of the opening/closing shaft in the first embodiment. FIG. 21 is a diagram illustrating a modified example of the opening/closing lever in the first embodiment. FIG. 22 is a diagram illustrating the opening/closing lever viewed along arrow XXII illustrated in FIG. 21. FIG. 23 is a diagram illustrating the opening/closing shaft and the opening/closing lever according to the modified examples in a state corresponding to the state illustrated in FIG. 19.

As illustrated in FIGS. 20 to 23, a recess 6*b* may be formed on the end of the opening/closing shaft 6, and a protrusion 32*f* may be formed on the opening/closing lever 32 such that the protrusion 32*f* fits in the recess 6*b*. Even in the case of such a configuration, it is possible to provide the opening/closing lever 32 attachable/detachable to/from the opening/closing shaft 6 and rotate the opening/closing shaft 6 as well by using the opening/closing lever 32.

Note that although the first embodiment has been described providing an example in which the opening/closing lever 32 is attached to the end of the opening/closing shaft 6, the present invention is not limited thereto. For example, referring back to FIG. 1, the opening/closing lever 32 may be attached to the opening/closing shaft 6 such that the opening/closing lever 32 is located between the shaft first lever 7 extending from the opening/closing shaft 6 toward the second tank 2*b* and the shaft first lever 7 extending from the opening/closing shaft 6 toward the third tank 2*c*. In this case, it is necessary to also provide the jack base 31 between the shaft first lever 7 extending from the opening/closing shaft 6 toward the second tank 2*b* and the shaft first lever 7 extending from the opening/closing shaft 6 toward the third tank 2*c*. For this reason, for example, the lid 22 may be rotated 180 degrees in a Z-X plane such that the mounting seat 23 can be provided between the shaft first lever 7 extending from the opening/closing shaft 6 toward the second tank 2*b* and the shaft first lever 7 extending from the opening/closing shaft 6 toward the third tank 2*c* and the jack base 31 can be fixed to the mounting seat 23. Furthermore, the opening/closing shaft 6 may include a portion having a hexagonal cross section and the hexagonal-cross-sectional portion is sandwiched between divided portions of the opening/closing lever such that the opening/closing lever is attachable and detachable.

The configuration described in the above embodiment exemplifies the subject matter of the present invention, and can be combined with another known technique, and omissions and changes can also be made to a part of the configuration without departing from the gist of the present invention.

REFERENCE SIGNS LIST

1 switch; 2 tank; 2*a* first tank; 2*b* second tank; 2*c* third tank; 3 fixed contact; 4 movable contact; 5 contact rod; 6 opening/closing shaft; 6*a* protrusion; 6*b* recess; 7 shaft first lever; 8 shaft second lever; 9 breaking torsion bar; 10 breaking shaft; 11 breaking lever; 12 breaking rod; 13 closing torsion bar; 14 housing; 15 operation device; 16 link mechanism; 21 main body; 22 lid; 23 mounting seat; 31 jack base; 31*a* first surface; 31*b* second surface; 31*c* penetrating portion; 31*d* jack-side recess; 32 opening/closing lever; 32*a* first surface; 32*b* second surface; 32*c* penetrating portion; 32*d* lever-side recess; 32*e* through hole; 32*f* protrusion; 33 opening/closing bolt; 33*a* head; 33*b* shaft; 34 jack adapter; 34*a* contact surface; 34*b* through hole; 35 lever adapter; 35*a* contact surface; 35*b* through hole; 36 thrust bearing; 37 opening/closing nut; 37*a* flange; 37*b* one portion; 37*c* other portion; 38 ratchet.

The invention claimed is:

1. A switch comprising:

a tank;

a fixed contact provided inside the tank;

a movable contact provided inside the tank and capable of reciprocating between a position where the movable contact is in contact with the fixed contact and a position away from the fixed contact;

an opening/closing shaft rotatably provided outside the tank, rotation of the opening/closing shaft moving the movable contact;

a jack base fixed to an outer side of the tank;

a torsion bar to store a force to rotate the opening/closing shaft so as to move the movable contact in a direction away from the fixed contact; and an opening/closing lever detachably attached to the opening/closing shaft, wherein the jack base has a first penetrating portion formed therethrough and facing the opening/closing lever, the opening/closing lever has a second penetrating portion formed therethrough and facing the jack base, and the switch further comprises:

a bolt inserted through the first penetrating portion and the second penetrating portion; and a nut attached to a portion of the bolt, the portion of the bolt extending out of the first penetrating portion and the second penetrating portion.

2. The switch according to claim 1, wherein the tank includes a tubular main body and a lid covering an end of the main body, the lid having an outer side surface defining the outer side of the tank, and a mounting seat is formed on the outer side surface of the lid and protrudes from the outer side surface of the lid, the jack base being fixed to the mounting seat.

3. The switch according to claim 2, further comprising:

a rod connected to the movable contact and extending through the lid; and an operation device to transmit the force stored in the torsion bar, to the opening/closing shaft, wherein the tank is plural in number, the plural tanks including a first tank, a second tank, and a third tank, the second tank being disposed side by side with the first tank, the third tank being disposed side by side with the second tank and located oppositely from the first tank, when the mounting seat is viewed in a direction in which the rod extends through the lid, the mounting seat is formed at a position offset from a position where the rod extends through the lid, the lid of the first tank is disposed in such a position that the mounting seat is located closer to the second tank than the position where the rod extends through the lid, the lid of the second tank is disposed in such a position that the mounting seat is located closer to the first tank than the position where the rod extends through the lid, the lid of the third tank is disposed in such a position that the mounting seat is located farther from the second tank than the position where the rod extends through the lid, the operation device is fixed to the mounting seat provided for the first tank and the mounting seat provided for the second tank, and the jack base is fixed to the mounting seat provided for the third tank.

4. The switch according to claim 1, wherein the jack base has a nut-facing portion facing the nut, the nut-facing portion having a jack-side recess provided thereon, the jack-side recess having an arc shape and a central axis parallel to a rotation axis of the opening/closing shaft, the opening/closing lever has a bolt-head-facing portion facing a head of the bolt, the bolt-head-facing portion having a lever-side recess provided thereon, the lever-side recess having an arc shape and a central axis parallel to the rotation axis of the opening/closing shaft, and the switch further comprises:

a lever adapter provided between the head of the bolt and the lever-side recess such that a shaft of the bolt is inserted through the lever adapter, the lever adapter having an arc surface formed in contact with the lever-side recess; and a jack adapter provided between the nut and the jack-side recess such that the shaft of the bolt is inserted through the jack adapter, the jack adapter having an arc surface formed in contact with the jack-side recess.

5. The switch according to claim 4, further comprising: a thrust bearing provided between the nut and the jack adapter.

6. The switch according to claim 1, wherein a protrusion having a polygonal shape is formed on the opening/closing shaft, a polygonal through hole is formed through the opening/closing lever, and the protrusion fits in the through hole.

7. The switch according to claim 1, wherein a recess having a polygonal shape is formed on the opening/closing shaft, a polygonal protrusion is formed on the opening/closing lever, and the protrusion fits in the recess.

* * * * *